United States Patent [19]

Amaral

[11] 4,258,522

[45] Mar. 31, 1981

[54] CONSTRUCTION BLOCKS

[76] Inventor: Jose A. Amaral, 3635 Stichman Ave., Baldwin Park, Calif. 91706

[21] Appl. No.: 40,299

[22] Filed: May 18, 1979

[51] Int. Cl.[3] ..... E04C 1/10

[52] U.S. Cl. ..... 52/591; 52/286; 52/589; 46/25

[58] Field of Search ..... 52/589–595, 52/284, 286, 564, 569; 46/25

[56] References Cited

U.S. PATENT DOCUMENTS 2,132,757 10/1938 Paulson ..... 46/25

FOREIGN PATENT DOCUMENTS 906913 3/1946 France ..... 52/284

591067 8/1947 United Kingdom ..... 52/286

*Primary Examiner*—James L. Ridgill, Jr.

*Attorney, Agent, or Firm*—Boniard I. Brown

[57] ABSTRACT

A system of construction blocks preferably constructed from plastic having interlocking sides, tops and bottoms which can be assembled with or without adhesive rather than mortar and which are strong, inexpensive, hollow and lightweight.

12 Claims, 12 Drawing Figures

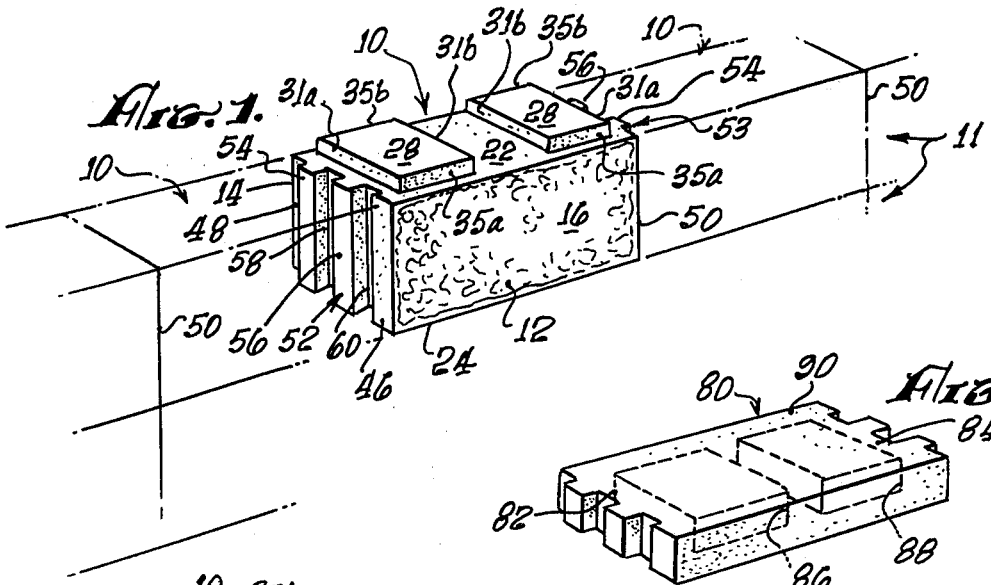
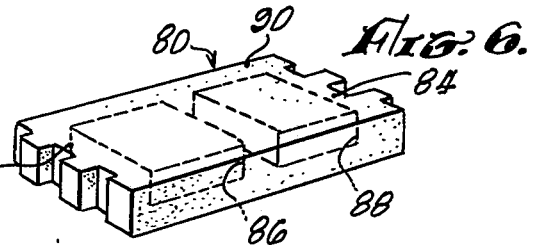
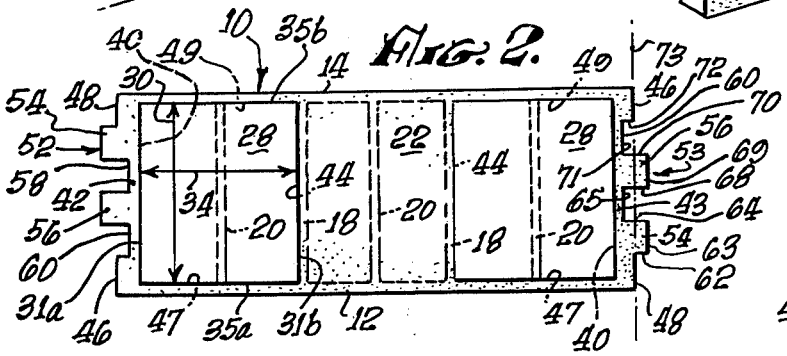
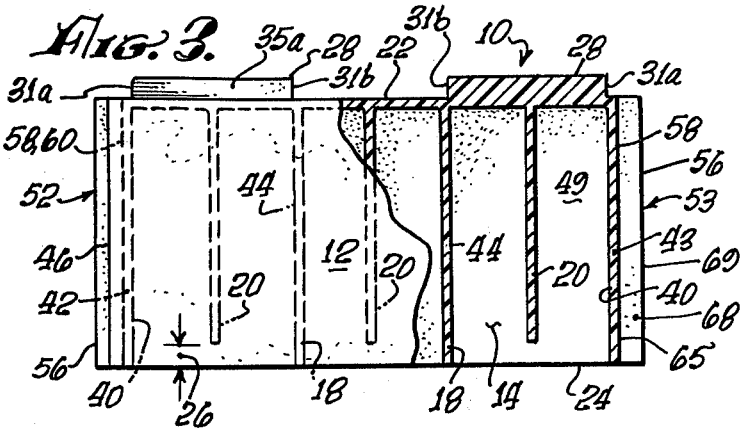
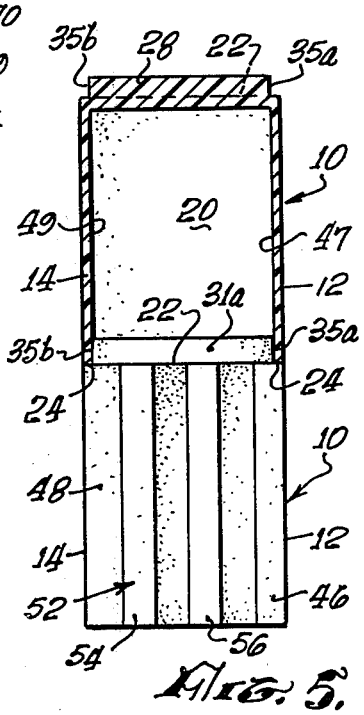
FIG. 5.
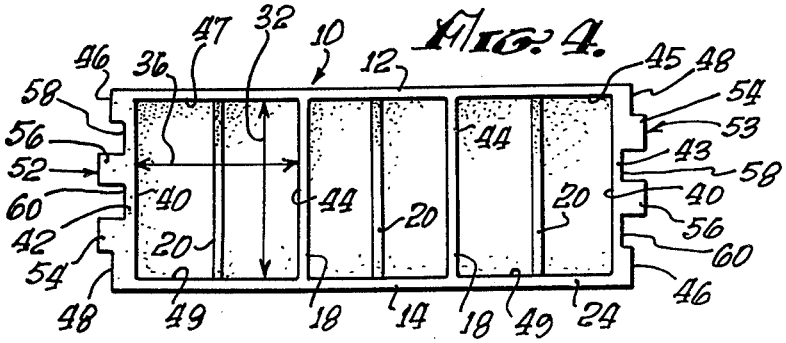

CONSTRUCTION BLOCKS

BACKGROUND OF THE INVENTION

Homeowners generally shy away from block construction since the blocks usually are concrete and require cement, sand, aggregate, water and special masonary tools to install. They are also heavy, and when exposed to view, provide an unfriendly impersonal appearance. Modifications to a wall or room divider made with such concrete blocks are difficult to accomplish since once the blocks are installed, it is difficult to cut portions thereof away for the installation of lights or other modifications. In many applications, the strength of the concrete blocks is not needed. Therefore, there has been a need for construction blocks which are useful in dividing areas or constructing light buildings such as play houses and dog houses where a substantial load does not need to be supported, and which can receive both colored and textured surface treatments at the time of manufacture.

BRIEF DESCRIPTION OF THE INVENTION

The present construction blocks are basically of two types, a non-overlapping type and an overlapping type both configured in a similar manner. The blocks can be provided to simulate almost any surface such as the surface of concrete blocks or bricks and grout. They preferably are constructed of plastic or other relatively inexpensive material and can be molded with exposed sides in any desired colors or textures. Each of the blocks, of normal configuration, has a generally hollow, sectioned interior, the sectioning being provided by transverse reinforcing walls which extend side to side in the interior thereof and from the top thereof down a predetermined distance dependent upon the longitudinal position thereof and whether the block is of the overlapping or non-overlapping type. The interior is closed at the ends of the block by a pair of planar wall surfaces which extend from a top surface to the normally open bottom. The exteriors of the ends each include a pair of outwardly extending vertically oriented columns of semi-rectangular cross-section and a pair of channels of similar semi-rectangular cross-section. The columns and channels are configured in left hand and right hand versions so that the left hand end of a block mates with the right hand end of an adjacent block. Except for top cap blocks, the top of each regular block includes at least two upstanding rectangular platforms of predetermined dimensions which are sized to fit between selected interior reinforcing walls of adjacent blocks. The other reinforcing walls do not extend down to the bottom of the block but instead are of a length so that they just rest on the top of an adjacent rectangular platform. When positioned together the blocks can be glued to form a permanent wall, or when overlapping types are used gravity and the friction between adjacent blocks can be used to create a standing but removable wall structure.

It is therefore an object of the present invention to provide light, low cost interlocking blocks for constructing walls and other types of generally non-load bearing planar structures;

Another object is to provide a block for wall building whose exposed exterior texture and color can be formed on the block prior to construction of the wall;

Another object is to provide plastic blocks suitable for decorative and semi-structural walls or room dividers;

Another object is to provide means with which is possible to construct a variety of decorative walls; and Another object is to provide a block interlock system which can be incorporated into blocks of various configurations such as half blocks, T-blocks, cap blocks and curved blocks.

These and other objects and advantages of the present invention will become apparent to those skilled in the art after considering the following detailed specification in conjunction with the accompanying drawings wherein:

BRIEF DESCRIPTION OF THE DRAWINGS

FIG. 1 is a perspective view of a non-overlapping block constructed according to the present invention in a wall construction;

FIG. 2 is a top plan view of the block of FIG. 1;

FIG. 3 is a side elevational view of the block of FIGS. 1 and 2 partially in cross-section;

FIG. 4 is a bottom plan view of the block of FIGS. 1, 2 and 3;

FIG. 5 is an end view of two blocks stacked on top of each other with the upper block shown in cross-section;

FIG. 6 is a perspective view of a cap block for the blocks of FIGS. 1 through 5;

DETAILED DESCRIPTION OF THE SHOWN EMBODIMENTS

Figure 7:
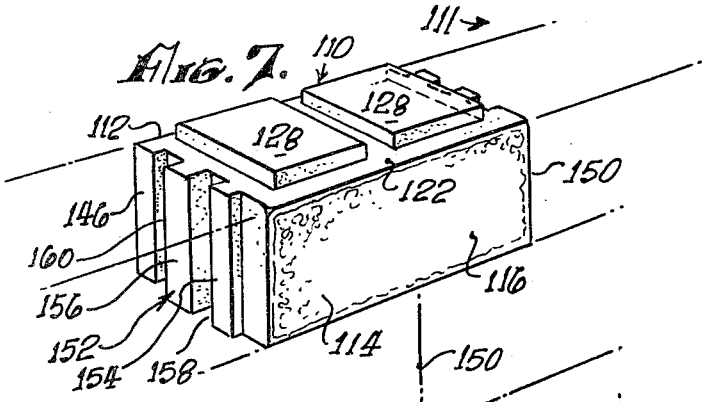
FIG. 7 is a perspective view of a block of the overlapping type constructed according to the present invention in position in a wall.
Figure 8:
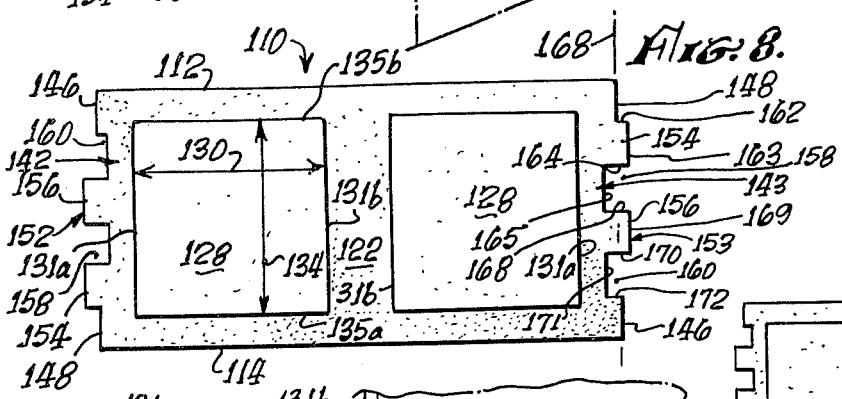
FIG. 8 is a top plan view of the block of FIG. 7.

Referring to the drawings more particularly by reference numbers, number 10 in FIG. 1 is a block of the non-overlapping type constructed according to the present invention in position in a block wall 11. The block 10 includes exposed sides 12 and 14 whose surfaces 16 may be textured to simulate concrete blocks and grout as shown, or maybe colored, transparent or textured as desired. The sides 12 and 14 are internally reinforced by a plurality of transverse walls 18 and 20 with the walls 18 extending from the top wall 22 of the block 10 to the bottom edges 24 of the sides 12 and 14 whereas the walls 20 extend from the top wall 22 down to a predetermined distance 26 above the bottom edge 24. The top wall 22 includes upwardly extending rectangular platforms 28 whose lateral dimension 30 between opposite side surfaces **35*a* and 35*b* is essentially the same as the inner distance 32 between the sides 12 and 14 and whose longitudinal dimension 34 between opposite end surfaces 31*a* and 31*b* is essentially the same as the distance 36 between the inner surface 40 of the endwall 42 and the facing surface 44 of the adjacent wall 18. When the blocks 10 are stacked as shown in FIG. 1, the rectangular platforms 28 enter the openings defined by the inner surfaces 47 and 49** of the side walls 12, 14 and the inner surfaces 40, 44 of the walls 42 and 18, and the side and end surfaces 31*a*, 31*b*, 35*a* and 35*b* engage and mate therewith.

The hidden side walls 42 and 43 of the block 10 include planar exterior surfaces 46 and 48. When the blocks 10 are placed together, they appear to form the adjacent edges 50 between side to side oriented blocks 10. As shown, each of the exterior surfaces 52 and 53 of the side walls 42 and 43 are divided into six portions which include two outwardly extending vertically oriented columns 54 and 56 and adjacent channels 58 and 60. The columns 54 and 56 and the adjacent channels 58 and 60 are formed with perpendicular and parallel surfaces so that the exterior surfaces 52 and 53 of the hidden side walls 42 and 43 include, from the exposed surface 16 of side 12, surface 48, and a longitudinally oriented vertical surface 62 perpendicular to surface 48 which connects to the outermost surface 63 of column 54. Another longitudinally oriented vertical surface 64 connects surface 63 to the innermost surface 65 of the channel 58. Surface 68 is provided which is parallel to surfaces 62 and 64 to connect surface 58 to surface 69, a surface on column 56 similar to surface 63. Surface 70 similar to surface 64 connects surface 69 to surface 71 which is the innermost surface of channel 60. A surface 72 similar to surface 62 connects surface 71 to surface 46. The surfaces 65 and 71 are equally distant inward from a plane 73 on which both surfaces 46 and 48 lay as surfaces 63 and 69 are positioned outwardly therefrom. The aforementioned surfaces which are shown as portions of exterior surface 53 in FIG. 2, appear on both side walls 42 and 43 but in left and right hand versions so that when blocks 10 are placed next to each other, the columns 54 and 56 fit within the channels 58 and 60 and vice versa to thereby interlock. If it is desired that the wall being constructed be of a relatively permanent nature, suitable adhesive can be applied to the mating surfaces of the blocks 10 to retain them in their mating position.

Caps 80 for the blocks 10 as shown in FIG. 6 are each constructed with hidden side walls 82 and 84 shaped like the hidden side walls 42 and 43 of the block 10 so that adjacent caps 80 also tend to interlock. Cavities 86 and 88 are provided within the caps 80 which are sized to fit over the upstanding rectangular platforms 28 and to provide a smooth upper surface 90 for the wall 11.

The overlapping type blocks 110 are shown in FIGS. 7 through 10 and are basically similar to the blocks 10 shown in FIGS. 1 through 5.

The block 110 shown in a wall 111 in FIG. 7, includes exposed sides 112 and 114 whose surfaces 116 may be textured to simulate concrete blocks and grout as shown, or maybe colored, transparent or textured as desired. The sides 112 and 114 are internally reinforced by a plurality of transverse walls 118 and 120 with the walls 118 extending from the top wall 122 of the block 110 to the bottom edges 124 of the sides 112 and 114 whereas the walls 120 extend from the top wall 122 down to a predetermined distance 126 above the bottom edge 124. The top wall 122 includes upwardly extending rectangular platforms 128 whose longitudinal dimension 130 between opposite side surfaces 131*a* and 131*b* is essentially the same as the inner distance 132 between the sides 112*b* and 114*b* and whose lateral dimension 134 between opposite end surfaces 135*a* and 135*b* is essentially the same as the distance 136 between the inner surface 140 of the endwall 142 and the facing surface 144 of the adjacent wall 118. When the blocks 110 are stacked as shown in FIG. 7, the rectangular platforms 128 of adjacent blocks enter the openings 135*a* and 135*b* formed between the inner surfaces 147 and 149 of the side walls 112 and 114 and the inner surfaces 140 and 144 of the walls 142 and 118 and the side and end surfaces 131*a*, 131*b*, 135*a* and 135*b* engage and mate therewith.

The hidden side walls 142 and 143 of the block 110 include planar exterior surfaces 146 and 148. When the blocks 110 are placed together, they appear to form the adjacent edges 150 between side to side oriented blocks 110. As shown, each of the exterior surfaces 152 and 153 of the side walls 142 and 143 are divided into six portions which include two outwardly extending vertically oriented columns 154 and 156 and adjacent channels 158 and 160. The columns 154 and 156 and the adjacent channels 158 and 160 are formed with perpendicular and parallel surfaces so that the exterior surfaces 152 and 153 of the hidden side walls 142 and 143 include, from the exposed surface 116 of side 112, surface 148, and a longitudinally oriented vertical surface 162 perpendicular to surface 148 which connects to the outermost surface 163 of column 154. Another longitudinally oriented vertical surface 164 connects surface 163 to the innermost surface 165 of the channel 158. Surface 168 is provided which is parallel to surfaces 162 and 164 to connect surface 158 to surface 169, a surface on column 156 similar to surface 163. Surface 170 similar to surface 164 connects surface 169 to surface 171 which is the innermost surface of channel 160. A surface 172 similar to surface 162 connects surface 171 to surface 146. The surfaces 165 and 171 are equally distant inward from a plane 173 on which both surfaces 146 and 148 lay as surfaces 163 and 169 are positioned outwardly therefrom. The aforementioned surfaces which are shown as portions of exterior surface 153 in FIG. 8, appear on both side walls 142 and 143 but in left and right hand versions so that when blocks 110 are placed next to each other, the columns 154 and 156 fit within the channels 158 and 160 and vice versa to thereby interlock. If it is desired that the wall being constructed be of a relatively permanent nature, suitable adhesive can be applied to the mating surfaces of the blocks 110 to retain them in their mating position.

Figure 11:
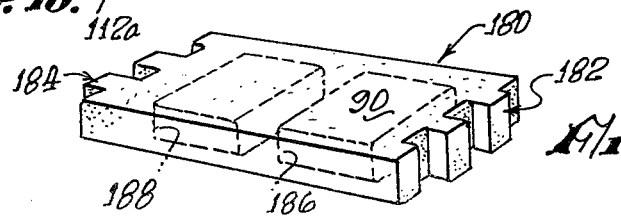
FIG. 11 is a perspective view of a cap block for the blocks of FIGS. 7 through 10.

Caps 180 for the blocks 110 as shown in FIG. 11 are each constructed with hidden side walls 182 and 184 shaped like the hidden side walls 142 and 143 of the block 110 so that adjacent caps 180 also tend to interlock. Cavities 186 and 188 are provided within the caps 180 which are sized to fit over the upstanding rectangular platforms 128 and to provide a smooth upper surface 190 for the wall 111.

Figure 9:
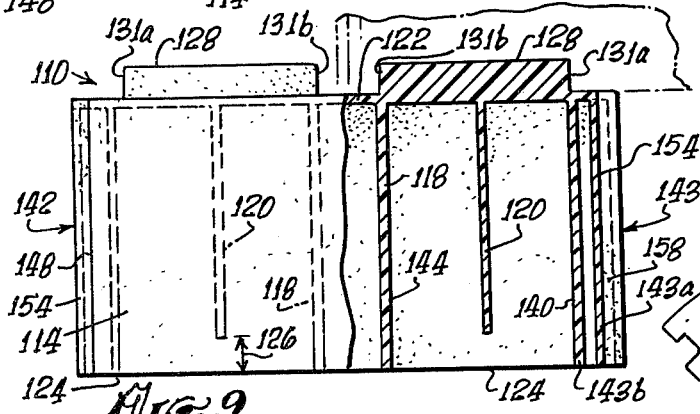
FIG. 9 is a side elevational view of the block of FIGS. 7 and 8 partially in cross-section.
Figure 10:
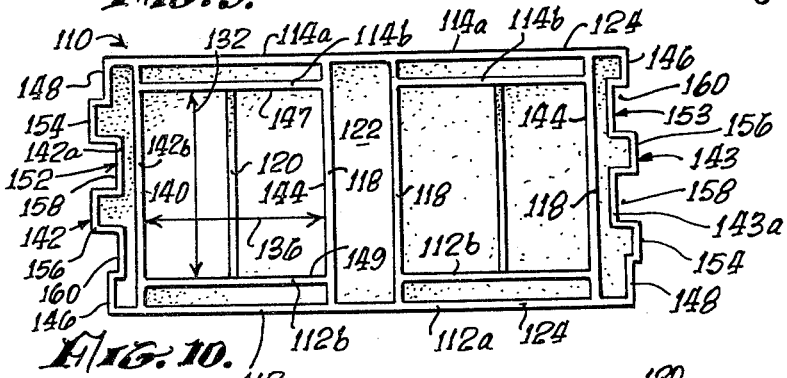
FIG. 10 is a bottom plan view of the block of FIGS. 7, 8 and 9.

Although discussed as if solid, the walls 112, 114, 142, and 143 can be constructed as hollow walls as shown in FIGS. 9 and 10. This is more appropriate for the case of overlapping blocks 110 because overlapping wall construction generally is stronger. The walls 112, 114, 142, and 143 as shown have outer and inner walls 112*a* and 112*b*, 114*a* and 114*b*, 142*a*, and 143*b* respectively. Surfaces 116 are formed on walls 112*a* and 114*a*, and surfaces 152 and 153 are formed on walls 142*a* and 143*a* respectively.

Figure 12:
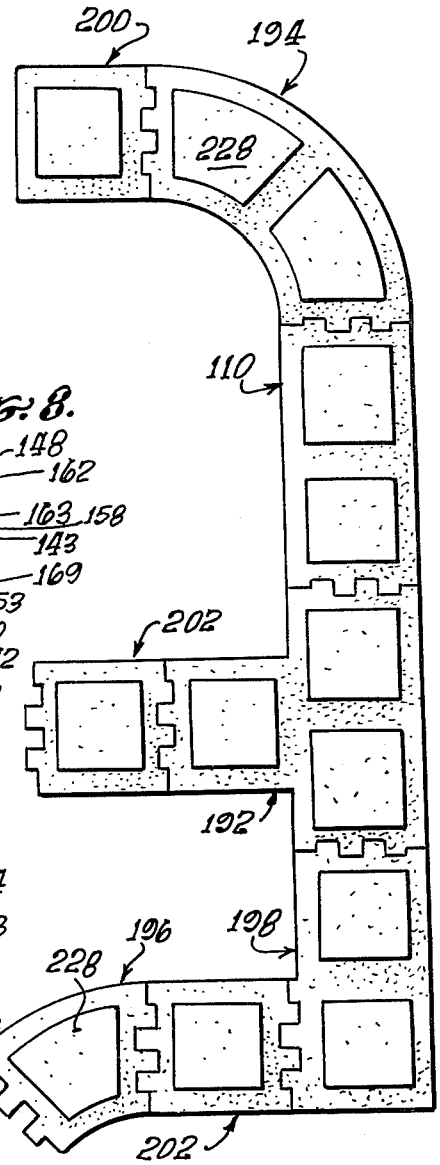
FIG. 12 is a top view of a wall constructed from some of the various configurations possible with blocks constructed according to the present invention.

FIG. 12 shows some of the configurations that are possible with blocks 10 and 110 constructed according to the present invention. For example, in addition the the standard block 110 discussed above, a Tee block 192, a full curved corner block 194, a half curved corner block 196, a full end block 198, a half end block 200, and a half block 202 are shown. It should be noted that the platforms 228 of the curved portions of blocks 194 and 196 are not rectangular but instead are semi-pie shaped as shown. The opening (not shown) in the underside of such blocks 194 and 196 is similiarly shaped. Caps for all of the above configurations can also be provided.

Thus, there has been shown and described novel light weight blocks which fulfill all the objects and advantages sought therefor. Many changes, modifications, variations and other uses and applications of the subject invention will however, become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

What is claimed is:

1. A construction block having:

a top;

a bottom;

first and second side walls having outer and inner wall surfaces; and first and second ends, at least said first end having an end surface which extends from said first side wall outer surface to said second side wall outer surface and which includes in order from said first side wall outer surface to said second side wall outer surface, a first end surface portion, a second end surface portion perpendicular to said first end surface portion, a third end surface portion perpendicular to said second end surface portion and closer to said second end than said first end surface portion, a fourth end surface portion perpendicular to said first and third end surface portions, a fifth end surface portion perpendicular to said second and fourth end surface portions and further from said second end than said first end surface portion, a sixth end surface portion perpendicular to said first, third and fifth end surface portions, a seventh end surface portion perpendicular to said second, fourth and sixth end surface portions and closer to said second end than said first end surface portion, an eighth end surface portion perpendicular to said first, third, fifth and seventh end surface portions, a ninth end surface portion perpendicular to said second, fourth, sixth and eighth end surface portions and further from said second end than said first end surface portion, a tenth end surface portion perpendicular to said first, third, fifth, seventh and ninth end surface portions, and an eleventh end surface portion perpendicular to said second, fourth, sixth, eighth and tenth end surface portions and in planar alignment with said first end surface portion.

2. The block as defined in claim 1 wherein said fourth, sixth, and eighth end surface portions have the same widths and lengths.

3. The block as defined in claim 2 wherein said second and tenth end surface portions have generally one half the width of said fourth, sixth, and eighth end surface portions and the same lengths.

4. The block as defined in claim 3 wherein said second end has an end surface which is the mirror image of said first end surface so that adjacent blocks can mate first end surface to second end surface.

5. The block as defined in claim 4 wherein said third and seventh end surface portions are positioned in planar relationship and said fifth and ninth end surface portions are positioned in planar relationship.

6. The block as defined in claim 4 wherein said top includes;

at least one upstanding platform, said platform having a predetermined height and said bottom defining at least one opening for receiving at least one of said platforms.

7. The block as defined in claim 6 further including:

first and second interior walls which extend from said first side wall inner surface to said second side wall inner surface, said first interior walls extending to said bottom and said second walls extending to a position which is above said bottom a distance generally equal to said predetermined height of said platform, said platform having a top surface and said second interior walls having a bottom surface adapted for adhesive bonding to said top surface of said platform, at least two of said first interior walls being spaced so that a platform of an adjacent block can nest therebetween and having at least one second interior wall therebetween.

8. The block as defined in claim 7 wherein said platform is rectangular in shape.

9. The block as defined in claim 7 wherein said first and second end walls are hollow and portions only of said first and second side walls are hollow.

10. The block as defined in claim 7 wherein said block is constructed from plastic.

11. The block as defined in claim 10 wherein said first and second outer side wall surfaces are textured and colored.

12. The block as defined in claim 10 wherein said first and second outer side wall surfaces are transparent.

* * * * *